United States Patent [19]

Rose et al.

[11] Patent Number: 4,694,973

[45] Date of Patent: Sep. 22, 1987

[54] WARMING DEVICE FOR DISPOSABLE TOWEL DISPENSER

[75] Inventors: K. Daniel Rose, Healdsburg; Charles Yarbrough, Kenwood; Alan F. Strachan, Santa Rosa, all of Calif.

[73] Assignee: Warmwipes, Inc., Santa Rosa, Calif.

[21] Appl. No.: 803,465

[22] Filed: Dec. 2, 1985

[51] Int. Cl.[4] ..... A47K 10/38; B65D 83/08

[52] U.S. Cl. ..... 221/46; 206/225; 219/521; 219/552; 219/214; 219/385; 219/418; 219/433; 221/63; 221/150 A; 362/154

[58] Field of Search ..... 221/24, 44–46, 221/49, 61, 63, 197, 199, 282, 286, 287, 307, 308, 310, 150 R, 150 A, 150 HC, 33, 41, 47, 56, 58, 59, 52; 222/113; 362/154, 226, 253, 397, 801, 807, 808; 219/521, 385, 214, 552, 433, 535, 418; 206/409, 225

[56] References Cited

U.S. PATENT DOCUMENTS

| | | | |
|---|---|---|---|
| 1,583,500 | 5/1926 | Smith | 219/214 X |
| 2,150,469 | 3/1939 | Tozer et al. | 221/130 |
| 2,413,176 | 12/1946 | Deaton | 219/521 |
| 2,795,353 | 6/1957 | Tuttle | 221/46 |
| 2,854,134 | 9/1958 | Humphrey | 221/46 U X |
| 3,005,192 | 10/1961 | Wyant | 362/154 X |
| 3,152,245 | 10/1964 | Litman | 219/433 |
| 3,343,716 | 9/1967 | Peebles | 221/46 |
| 4,004,711 | 1/1977 | Ravich | 221/150 A X |
| 4,084,080 | 4/1978 | McMahan | 219/521 X |
| 4,117,309 | 9/1978 | Cayley | 219/521 X |
| 4,180,160 | 12/1979 | Ogawa et al. | 221/63 X |
| 4,289,253 | 9/1981 | Andersson | 221/150 A X |
| 4,495,402 | 1/1985 | Burdick et al. | 221/150 A X |

FOREIGN PATENT DOCUMENTS

| | | | |
|---|---|---|---|
| 30292 | 2/1933 | Netherlands | 219/521 |

*Primary Examiner*—Joseph J. Rolla
*Assistant Examiner*—Kevin P. Shaver
*Attorney, Agent, or Firm*—Townsend and Townsend

[57] ABSTRACT

A device for warming and illuminating pre-packaged, pre-wetted disposable towels is provided. The unit also secures a plastic canister of disposable towels so that the towels may be dispensed with one hand. A cup sized to enclose the canister in an upper sector has a supporting dish, upon the upper surface of which is provided a series of lips to engage various diameter plastic canisters containing the towels. The dish has a recessed bowl at its center in which one or more small incandescent light bulbs are mounted to warm the fluid pool within the canister and to provide illumination through a translucent window portion of the cup. The top of the dispenser is capped to retain the container from above, while the dish is spring mounted within the cup to assure a snug vertical fit of the container within the cup. A dispenser opening is provided in the cap of the unit, through which the towels from the container are pulled out. A suction cup at the base of the cup secures the entire unit to another surface to assure that the dispenser does not move as towels are being dispensed.

23 Claims, 5 Drawing Figures

WARMING DEVICE FOR DISPOSABLE TOWEL DISPENSER

BACKGROUND OF THE INVENTION

1. Field of the Invention

The present invention relates to an illuminated apparatus for warming and dispensing pre-packaged, pre-wetted disposable towels.

2. Description of Related Art

In recent years, small pre-wetted paper or fabric towels which are disposable, and are packaged in plastic canisters, have become available to the general public. The towels are typically rolled or folded to fit within the canister so as to be dispensed one at a time from the top of the container. A reservoir of the wetting fluid, which typically contains a cleansing agent, is located in a pool at the bottom of the canister. The towels are wetted through capillary action.

These disposable towels are used for a variety of purposes, most of which involve contact between the towels and human skin. Perhaps one of the more predominant uses of the disposable towels is for cleansing the diaper areas of infants. Since the towels are typically kept at room temperature, there is an average temperature difference of about 30 degrees Fahrenheit between the skin of the infant and the temperature of the wet towel. This temperature difference causes discomfort to the user. In younger babies, the infant's startle reflex is triggered when the towel touches its skin, and crying often ensues.

The towels are dispensed from their plastic canisters through a small opening in the top of the container. The small opening prevents the excess liquid from spilling out of the container, should the canister be upset from its normal upright position, and prevents evaporation of the liquid. The towels are removed from the canister through a small opening. The weight of the canister is insufficient to overcome the frictional contact between the towel and the canister. In order to remove a single towel from the opening, it is generally necessary to grip the container with one hand as the towel is pulled out of the opening with the remaining hand, resulting in a momentary hazard to the infant which may be unrestrained on an elevated changing table while the parent is extracting the towel. Similarly, disposable towels are also commonly used to remove cosmetics. It would be far more convenient if the towels could be removed with one hand, leaving the other hand free.

SUMMARY OF THE INVENTION

The present invention provides a device which economically and efficiently warms the disposable towels while they remain in their original canister, secures the towel canister to provide for one-handed dispensing of towels, and provides a night light. The device is a dispenser for disposable towels which consists of a cup which has an upper sector into which the canister fits, and a lower sector beneath the upper sector in which one or more incandescent light bulbs heat the reservoir of fluid in the lowest end of the canister. The cup also secures the canister to facilitate one-handed dispensing of the towels.

The light from the incandescent light bulbs is sufficient to warm the liquid in the canister to a comfortable 110° F., yet is of a low intensity, so as not to disturb a sleeping child. The power demand of such incandescent bulbs is very low, and the amount of heat generated is sufficient to warm the liquid through the walls of the plastic container without danger of melting or igniting the plastic container itself. The device may safely be left plugged in for long periods of time without fear of fire.

Disposable pre-wetted towels are sold in plastic canisters of various sizes and shapes. The canisters are usually constructed from a molded thermoplastic, and are cylindrical or rectangular in shape. The dispenser of the present invention is designed to accommodate one or more sizes of similar shaped canisters, without any loss in heating efficiency. These and other features of the invention are more easily understood with reference to the following figures.

DESCRIPTION OF THE PREFERRED EMBODIMENT

Figure 1:
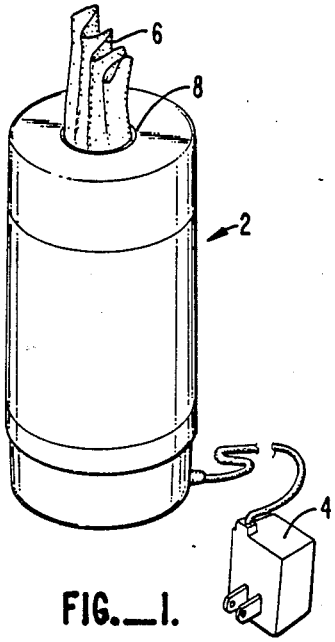
FIG. 1 is a perspective illustration of the dispenser unit.

The dispenser unit 2, with an installed canister of disposable towels, is illustrated in FIG. 1. The towels 6 protrude from the dispenser opening 8 at the top of the unit 2. The device requires a power supply, preferably consisting of a wall mount 12 volt transformer 4 or any suitable power supply such as an automobile cigarette lighter or 110 volts from conventional home circuits. The dispenser unit is designed to warm the disposable towels 6 continuously to approximately 110 degrees Fahrenheit, and may safely be left plugged in and unattended over long periods of time. All parts of the device must safely be able to withstand the amount of heat generated by the incandescent light bulbs.

Figure 2:
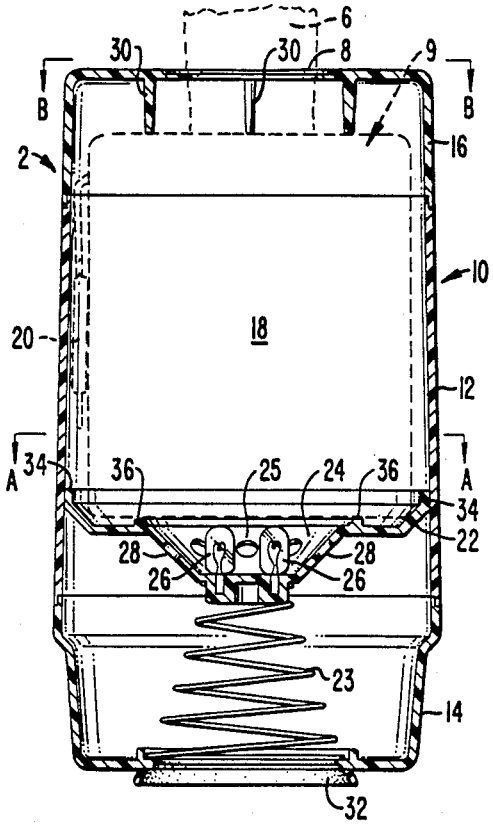
FIG. 2 is a sectional view of the dispenser unit.

FIG. 2 is a sectional view of the unit 2 taken longitudinally through a diameter of the unit. The outline of a disposable towel canister 9 is indicated by broken lines. In this particular embodiment, the dispenser cup, generally designated as 10, is a right circular cylinder in shape and is fabricated in three parts. Of course, it is understood that the dispenser might also be rectangular in shape or any polygonal shape as well. The cup 10 consists of the main tube section 12, a base 14 and a cap 16.

Cap 16 must be removed to install the disposable towel canister 9 in upper sector 18. The cover 20 for the towel canister, typically attached to canister 9 by a strip of plastic is folded down alongside the canister while it is installed in the unit 2. The canister 9 rests at its bottom on the dish 22. The dish 22 is biased upwardly by a spring 23. At the center of dish 22 is a recessed bowl 24, defining a lower sector 25, in which the incandescent light bulbs 26 are mounted. A series of holes 28 (see FIG. 3) are provided in the wall of the bowl 24. The base portion 14 of cup 10 is formed from a translucent material so that light passing through the holes 28 illuminate the base 14.

The upper end of canister 9 is restrained by a series of upper stop protrusions 30 which project downwardly from the cap 16 into the upper section 18. The protrusions 30 prevent the canister 9 from moving in an upward direction as a towel is being pulled out of the container and urge the container into contact with the disk 22. The upper stop protrusions in cooperation with the spring mounted dish 22 assures a snug fit for containers of different heights within the unit. The combined weight of the unit 2 and the canister 9 may alone be sufficient to permit one-handed dispensing of towels from the canister 9. A suction cup 32 at the undersurface of the base 14 secures the unit 2 to another surface to assure that the device does not move as a towel is being removed. The suction cup also prevents an infant from inadvertently knocking the dispenser off of the dressing table.

The unit 2 adjusts to efficiently warm disposable towels packaged in canisters of various sizes. Any resistance heating circuit would be suitable, although in the preferred embodiment, incandescent light bulbs are used.

Figure 3:
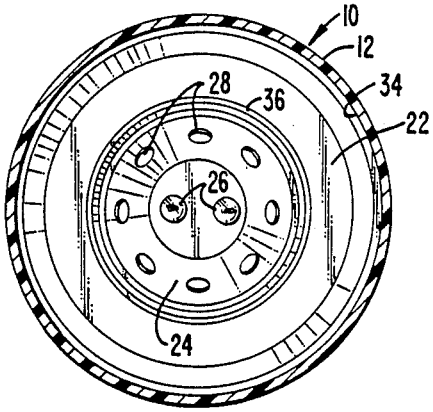
FIG. 3 is a detail plan view taken along the line A—A.

The dish 22 is generally concave in shape, and is provided with shoulders which engage the perimeter of the canister (see FIG. 3). For a large canister 9, such as is illustrated, the container rests against the outer shoulder formed by the lip 34. The perimeter of a smaller canister (not illustrated) would be engaged by the inner shoulder formed by the lip 36. In either case, there would be an air space in lower sector 25 formed by the bottom of the canister 9, bounded by the shoulder formed by the applicable lip and the walls of bowl 24. Within this lower sector 25, the bulbs 26 would be separated from any contact with the canister 9. This configuration places the bulbs as close as possible to the canister bottom when installed in the unit, which improves the heating of the fluid pool at the base of the container.

To improve the heat transfer characteristics of the device, the interior surface of the bowl 24 might be coated with reflective material. Also, the walls of the tube section 12 might be covered with insulation to prevent heat loss. The dispenser opening 8 of the cap 16 is also minimized in size in order to prevent heat loss to the surrounding atmosphere.

Figure 4:
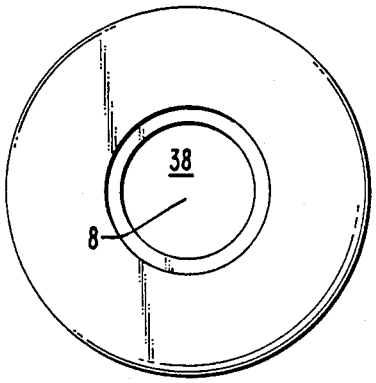
FIG. 4 is a detail plan view taken along the line B—B.
Figure 5:
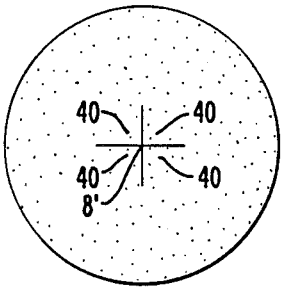
FIG. 5 is a plan view of the top of an alternative embodiment of the invention.

FIGS. 4 and 5 illustrate in plan views two alternate embodiments of the cap 16. In FIG. 4, the dispenser opening 8 is simply a hole 38 at the center of the cap through which the towels pass. In such a case, a separate lid (not illustrated) might be provided for the dispenser so that heat loss would be minimized while the device is not being used. FIG. 5 illustrates a cap in which the dispenser opening 8′ consists of a pair of perpendicular slots, forming flaps 40 in a sheet of somewhat flexible material stretched across the center of the cap. Towels would pass through the opening formed as the flaps 40 are deflected upwardly. Once the towel has been pulled through, the flaps would relax into a horizontal position, minimizing the opening to prevent heat loss.

The device of the present invention may be inexpensively manufactured through injection molding techniques. The simplicity of the heating system also minimizes the operating cost by utilizing very energy efficient components. The exterior appearance of the dispenser may be customized to present an attractive appearance which makes the dispenser a piece of furniture adaptable to any decor. While the above provides a full and complete disclosure of the preferred embodiments of the invention, various modifications, alternate constructions, and equivalents may be employed without departing from the true spirit and scope of the invention. For instance, a simple resistance heating circuit could be substituted for the incandescent light bulbs as the heat source. Further, the dispenser might also be constructed without a heat source, and used simply to facilitate the one-handed removal of disposable towels from their canisters. Therefore, the above description and illustrations should not be construed as limiting the scope of the invention which is defined by the appended claims.

What is claimed is:

1. A dispenser for disposable pre-wetted towels prepackaged in plastic canisters, comprising:

a cup having an upper sector sized and adapted to contain a canister and a dispenser opening in said upper sector, and a lower sector below said upper sector;

securing means to secure the canister in said upper sector of said cup, said securing means further comprising uplift means for urging the canister upwardly towards said dispenser opening of said upper sector;

incandescent light bulb means disposed within said lower sector of said cup and mounted on said uplift means for heating the canister in said cup; and a translucent window disposed in said lower sector to be illuminated by said incandescent light bulb means.

2. The dispenser of claim 1, wherein said upper sector of said cup is covered with insulation, and said lower sector is provided with gripping means for securing the bottom of said cup to a smooth surface.

3. The dispenser of claim 2, wherein said gripping means comprises a suction cup.

4. The dispenser of claim 1, wherein said securing means for said canister further comprises engagement means within said cup for engaging the exterior of said canister, said engagement means comprising plural lip means capable of engaging canisters of different sizes within said cup.

5. The dispenser of claim 4, wherein said engagement means further comprises a dish separating said upper sector from said lower sector, and biased by said uplift means away from the bottom of said cup, said dish having a recessed bowl at its center wherein said incandescent light bulb means is mounted, said dish having thereon said plural lip means, said plural lip means comprising a series of upwardly extending concentric, circumferentially said means for securing being disposed lips for flexibly and removably engaging the perimeter of different sized canisters.

6. The dispenser of claim 1, wherein said uplift means comprises a spring mounted in said lower sector of said cup to urge the canister upwardly towards said dispenser opening.

7. The dispenser of claim 6, wherein said cup is tubular and open at the upper end, and wherein said securing means further comprises upper stop means to prevent the upward movement of the canister as a towel is being dispensed.

8. The dispenser of claim 7, wherein said upper stop means comprises a removable cap having at least one downwardly extending stop protrusion spaced around a dispenser opening of the cup and extending from the cap undersurface towards the interior of said cup.

9. The dispenser of claim 7, wherein said upper stop means comprises a removable cap which engages the top of said cup and extends over at least a portion of the top of the canister.

10. The dispenser of claim 9, wherein said removable cap further comprises a sheet extending across a center portion of the cap, said sheet having at least one dispensing slot.

11. A dispenser for pre-wetted disposable towels packaged in a canister, comprising:

a tubular cup having an upper sector sized to retain the canister and a dispenser opening in said upper sector for removing the disposable towels;

securing means for securing the canister in said upper sector of said tubular cup, said securing means including uplift means for urging the canister upwardly towards said dispenser opening of said upper sector;

a resistive heating means which emits light, said resistive heating means mounted on said uplift means;

a translucent window in said lower sector of said cup, said translucent window adjacent said resistive heating means; and spacer means for separating said resistive heating means from contact with the bottom of the canister.

12. The dispenser of claim 11, wherein said cup further comprises a cap for said cup, said cup having dispenser opening therein, said dispenser opening comprising a slotted deformable sheet extending across the top of said cup.

13. The dispenser of claim 11, wherein said resistive heating means comprises at least one incandescent light bulb.

14. The dispenser of claim 13, wherein said securing means comprises a cap having upper stop means disposed across the top of said upper sector and wherein said uplift means comprises biasing means in said lower sector for urging the canister upwardly into said upper stop means, and said spacer means comprises a recessed bowl wherein said incandescent light bulb means is mounted.

15. The dispenser of claim 14, wherein said recessed bowl is provided with at least one illuminating hole adjacent said translucent window in said cup whereby said translucent window is illuminated by said incandescent light bulb means.

16. The dispenser of claim 14, wherein said recessed bowl is translucent and is mounted adjacent said translucent window of said cup.

17. A dispenser for pre-wetted disposable towels housed in a plastic canister, comprising:

a cup, having a tubular body with an upper sector sized to enclose a variety of sizes of said plastic canisters;

incandescent light bulb means disposed adjacent the bottom of said cup in a lower sector of said cup;

a concave dish, dividing said upper sector and said lower sector;

spring means below said dish for biasing the dish upwards from the bottom of said cup;

a depression within said dish, in which said incandescent light bulb means is mounted;

means for securing said canister in said cup, said means for securing being disposed along the upper surface of said dish for removably engaging the perimeter of said variety of sizes of canisters and seating the canisters above said depression and further comprising a removable cap for said cup, said cap further comprising a dispenser opening and upper stop means to restrain the canister from moving upwardly as a towel is removed from the canister; and translucent window means provided in said lower sector of said cup adjacent said incandescent light bulb means.

18. The dispenser of claim 17, wherein said dish further comprises a reflective surface along its upper surface thereof, and said means for securing further comprises upwardly directed, circumferentially and concentrically arranged lips sized to accommodate the perimeter of said variety of sizes of said canisters.

19. The dispenser of claim 17, wherein said cup is circular in cross-section.

20. The dispenser of claim 17, wherein said cup further comprises mounting means along the undersurface of said cup for mounting said cup to a separate surface.

21. The dispenser of claim 20, wherein said mounting means comprises a suction cup.

22. A dispenser for pre-wetted disposable towels packaged in a plastic canister, comprising:

a tubular cup having an upper sector sized to retain the canister and having a sealable dispenser opening;

securing means for securing the canister in said upper sector of said tubular cup, said securing means comprising uplift means for biasing the plastic canister upwardly towards said sealable dispenser opening;

resistive heating means mounted in a lower sector of said cup, said lower sector being constructed from a translucent material, said resistive heating means comprising at least one incandescent light bulb;

divider means within said cup for separating said upper sector from said lower sector, said divider means comprising a concave dish within said cup, spaced apart and biased by said uplift means away from the bottom of said cup; and spacer means for separating said resistive heating means from contact with the bottom of the canister, said spacer means comprising a recessed bowl in said dish in which said incandescent light bulb means is mounted.

23. A dispenser for disposable pre-wetted towels prepackaged in plastic canisters, comprising:

a cup having an upper sector sized and adapted to contain a canister, and a lower sector below said upper sector;

a sealable dispenser opening in said upper sector;

incandescent light bulb means disposed within said lower sector of said cup, spaced apart from the bottom of the cup for heating said canister in said cup at least a first portion of said lower sector of said cup being constructed from translucent material, such that said first portion of said cup is illuminated by said incandescent light bulb means;

means for securing said canister within said upper sector comprising uplift means urging said canister towards said sealable dispenser opening and adapted for removably retaining and securing said canister within said cup; and engagement means for engaging said canister, said engagement means comprising a dish separating said upper sector from said lower sector, and biased by said uplift means away from the bottom of said cup, said dish having a recessed bowl at its center wherein said incandescent light bulb means is mounted.

* * * * *